US007270165B1

(12) United States Patent
Chuang

(10) Patent No.: US 7,270,165 B1
(45) Date of Patent: Sep. 18, 2007

(54) VERTICAL CURTAIN

(76) Inventor: Shan-Chi Chuang, 23, Wucyuan 5th Rd., Wugu Township, Taipei County (TW)

( * ) Notice: Subject to any disclaimer, the term of this patent is extended or adjusted under 35 U.S.C. 154(b) by 329 days.

(21) Appl. No.: 11/111,208

(22) Filed: Apr. 21, 2005

(51) Int. Cl.
*E05D 15/06* (2006.01)

(52) U.S. Cl. ..... 160/197; 160/202

(58) Field of Classification Search ..... 160/197, 160/184, 202, 211, 332, 126, 168.1 V, 900
See application file for complete search history.

(56) References Cited

U.S. PATENT DOCUMENTS 3,262,488 A * 7/1966 Rieder ..... 160/202
3,348,603 A * 10/1967 Ford ..... 160/197
3,911,991 A * 10/1975 Malferrari ..... 160/202
4,221,255 A * 9/1980 Barkemeyer ..... 160/197
5,109,910 A * 5/1992 Tortorella et al. ..... 160/197
6,892,783 B1 * 5/2005 Comeau et al. ..... 160/126
7,174,944 B1 * 2/2007 Clark et al. ..... 160/197

* cited by examiner

*Primary Examiner*—David Purol
(74) *Attorney, Agent, or Firm*—Alan Kamrath; Kamrath & Associates PA

(57) ABSTRACT

A vertical curtain includes a track having two ends each provided with a plurality of support brackets juxtaposed to each other, and two drawing blocks movably mounted on the two ends of the track and connected to one of the support brackets to push the support brackets. Each of the support brackets is movably mounted on the track and provided with a slide member, a fastening member, a limit member and a stop member. Thus, the slide member has a plurality of passages having different positions for mounting the vertical slats so that the track can be used to combine with multiple vertical slats, and the vertical curtain is available for windows having larger sizes, thereby enhancing the versatility of the vertical curtain.

16 Claims, 7 Drawing Sheets

VERTICAL CURTAIN

BACKGROUND OF THE INVENTION

1. Field of the Invention

The present invention relates to a vertical curtain, and more particularly to a vertical curtain for mounting multiple vertical slats.

2. Description of the Related Art

A conventional vertical curtain comprises a plurality of vertical slats, and two tracks for hanging the vertical slats so that the vertical slats are movable between the two tracks. Each of the vertical slats has a larger width so that it is necessary to provide two tracks for supporting the vertical slats. However, the vertical curtain needs to provide two tracks for supporting the vertical slats, so that the vertical curtain occupies a larger space. In addition, the two tracks are protruded outward from the wall, thereby decreasing the outer appearance of the vertical curtain.

Another conventional vertical curtain comprises three vertical slats, and a track for hanging the three vertical slats so that the three vertical slats are movable on the track. However, the vertical curtain only has three vertical slats and cannot provide more than three vertical slats, so that the vertical curtain is not available for windows having a larger size, thereby limiting the versatility of the vertical curtain.

SUMMARY OF THE INVENTION

The primary objective of the present invention is to provide a vertical curtain for mounting multiple vertical slats.

Another objective of the present invention is to provide a vertical curtain, wherein the slide member has a plurality of passages having different positions for mounting the vertical slats so that the track can be used to combine with multiple vertical slats, and the vertical curtain is available for windows having larger sizes, thereby enhancing the versatility of the vertical curtain.

A further objective of the present invention is to provide a vertical curtain, wherein the support brackets are in turn pulled successively by interaction between the limit member and the stop member so that the vertical slats are expanded and folded easily and conveniently, thereby facilitating a user closing and opening the vertical curtain.

Further benefits and advantages of the present invention will become apparent after a careful reading of the detailed description with appropriate reference to the accompanying drawings.

DETAILED DESCRIPTION OF THE INVENTION

Figure 1:
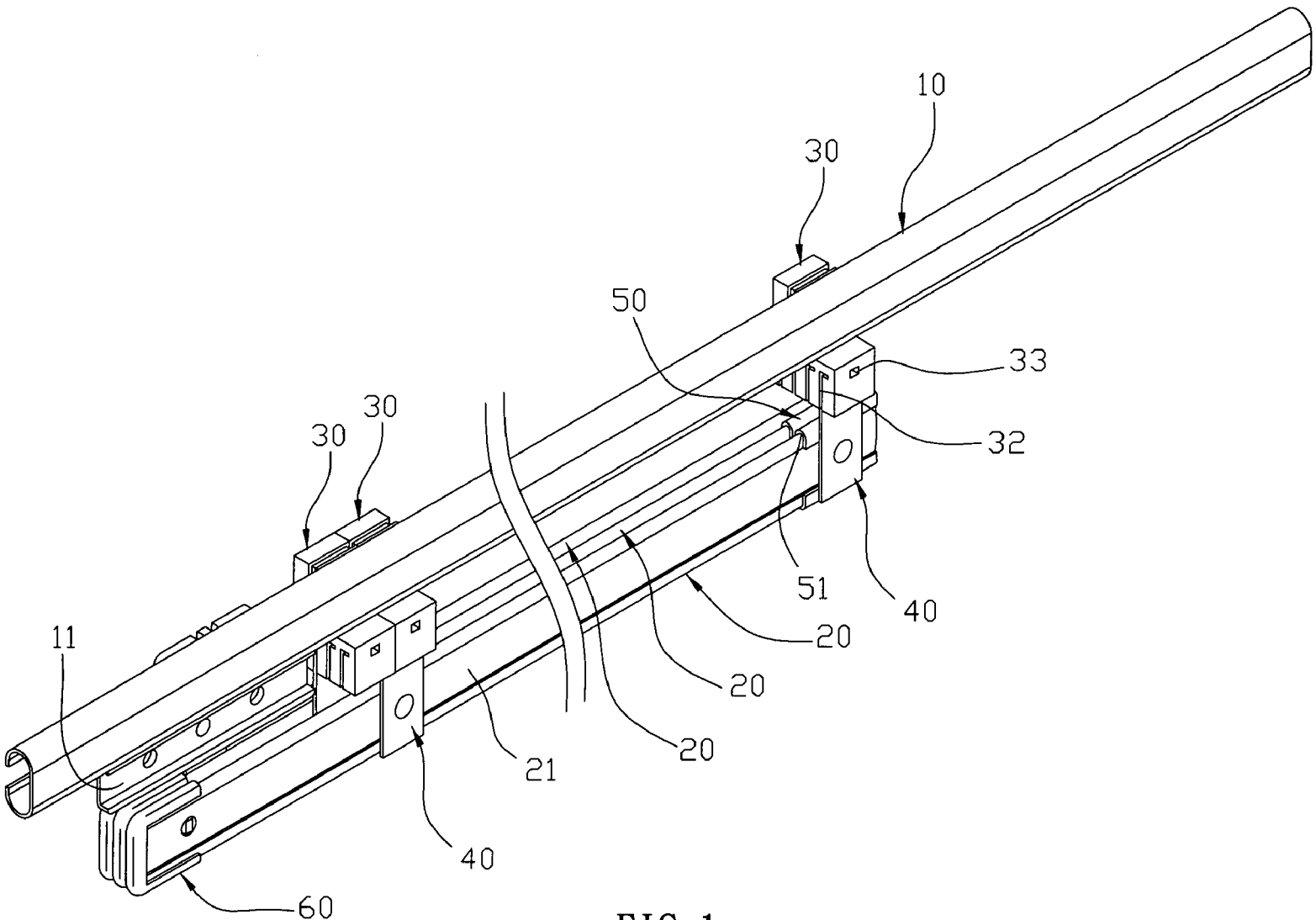
FIG. 1 is a partially perspective view of a vertical curtain (located at an opened state) in accordance with the preferred embodiment of the present invention.

Referring to the drawings and initially to FIGS. 1-5, a vertical curtain in accordance with the preferred embodiment of the present invention comprises a track 10 having two ends each provided with a plurality of support brackets 20 juxtaposed to each other as shown in FIG. 1, and two drawing blocks 11 movably mounted on the two ends of the track 10 and connected to one of the support brackets 20 to push the support brackets 20. The two drawing blocks 11 are connected to a pull cord (not shown) so that each of the two drawing blocks 11 is driven by the pull cord to push the support brackets 20 to move from the two ends of the track 10 toward a middle portion of the track 10 or to move from the middle portion of the track 10 toward the two ends of the track 10.

Each of the support brackets 20 is movably mounted on the track 10 and provided with a slide member 30, a fastening member 40, a limit member 50 and a stop member 60. Each of the support brackets 20 is combined with a vertical slat 70 by the fastening member 40. The track 10 is a substantially C-shaped tubular body. Each of the support brackets 20 has a side provided with a bonding strap 21.

Figure 5:
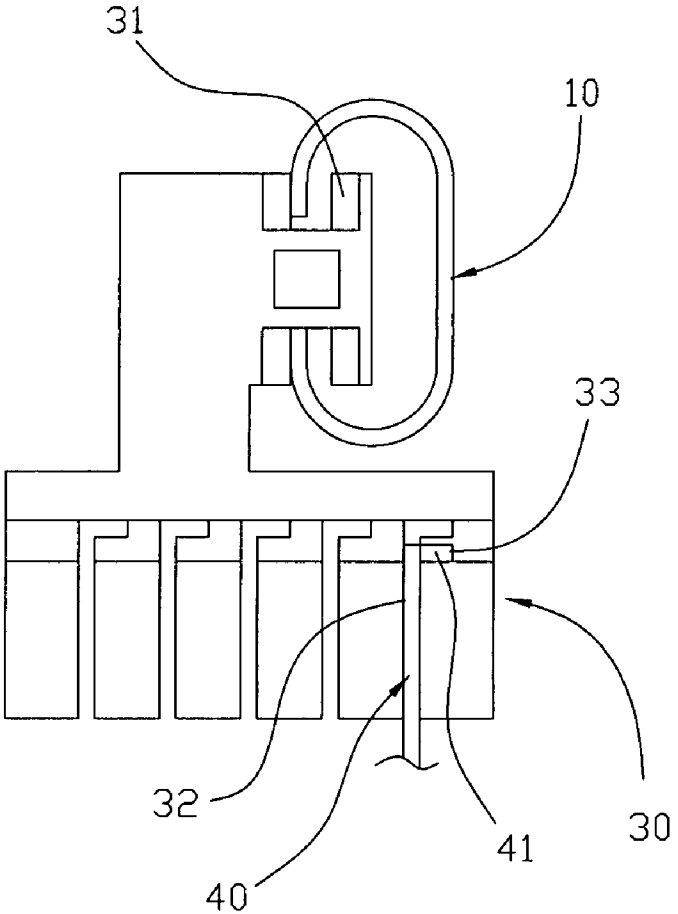
FIG. 5 is a partially side plan view of the vertical curtain as shown in FIG. 1.
Figure 4:
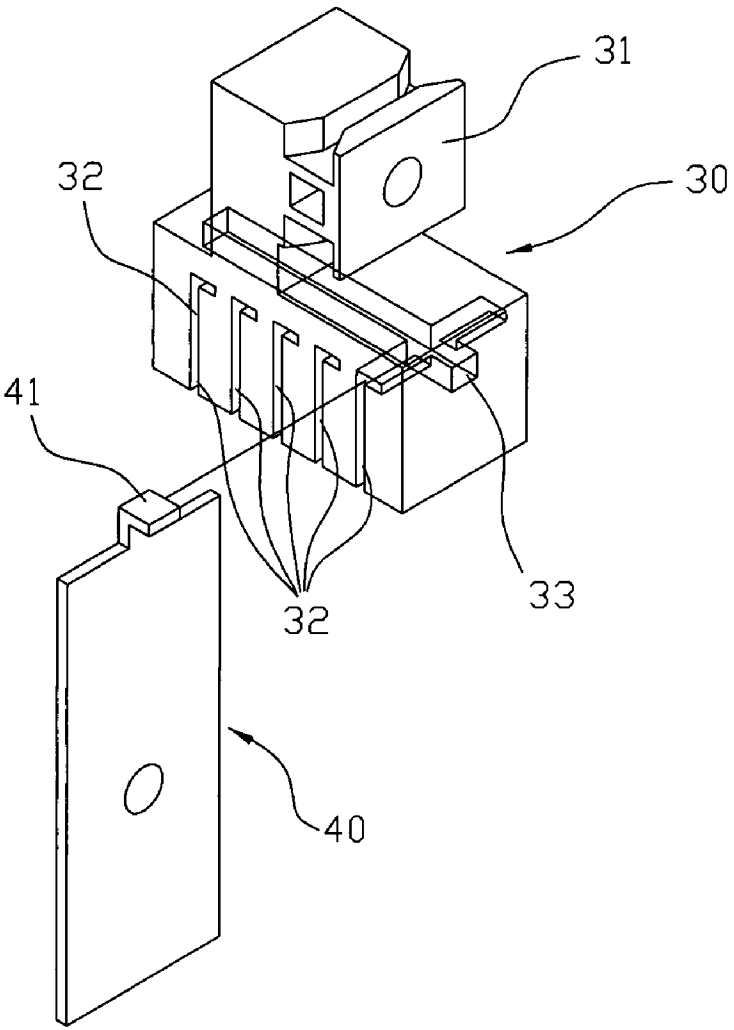
FIG. 4 is a partially exploded perspective view of the vertical curtain as shown in FIG. 1.

As shown in FIGS. 4 and 5, the slide member 30 has a first end formed with a slide portion 31 slidably mounted on the track 10 and a second end having an inside formed with an elongated positioning groove 33 and an end face formed with a plurality of substantially inverted L-shaped passages 32 each connected to the positioning groove 33. Each of the passages 32 has an upper portion located at a height greater than that of the positioning groove 33. The fastening member 40 has a first end attached to the slide member 30 to move therewith. The first end of the fastening member 40 is formed with a hanging hook 41 extended through either one of the passages 32 of the slide member 30 and detachably positioned in the positioning groove 33 of the slide member 30. Thus, the first end of the fastening member 40 is removably mounted on and can be detached from the slide member 30. The fastening member 40 has a second end secured to the respective support bracket 20 to move the respective support bracket 20. The vertical slat 70 has an upper end located between the respective support bracket 20 and the second end of the fastening member 40 and provided with a bonding strap 71 detachably bonded on the bonding strap 21 of the respective support bracket 20.

Figure 2:
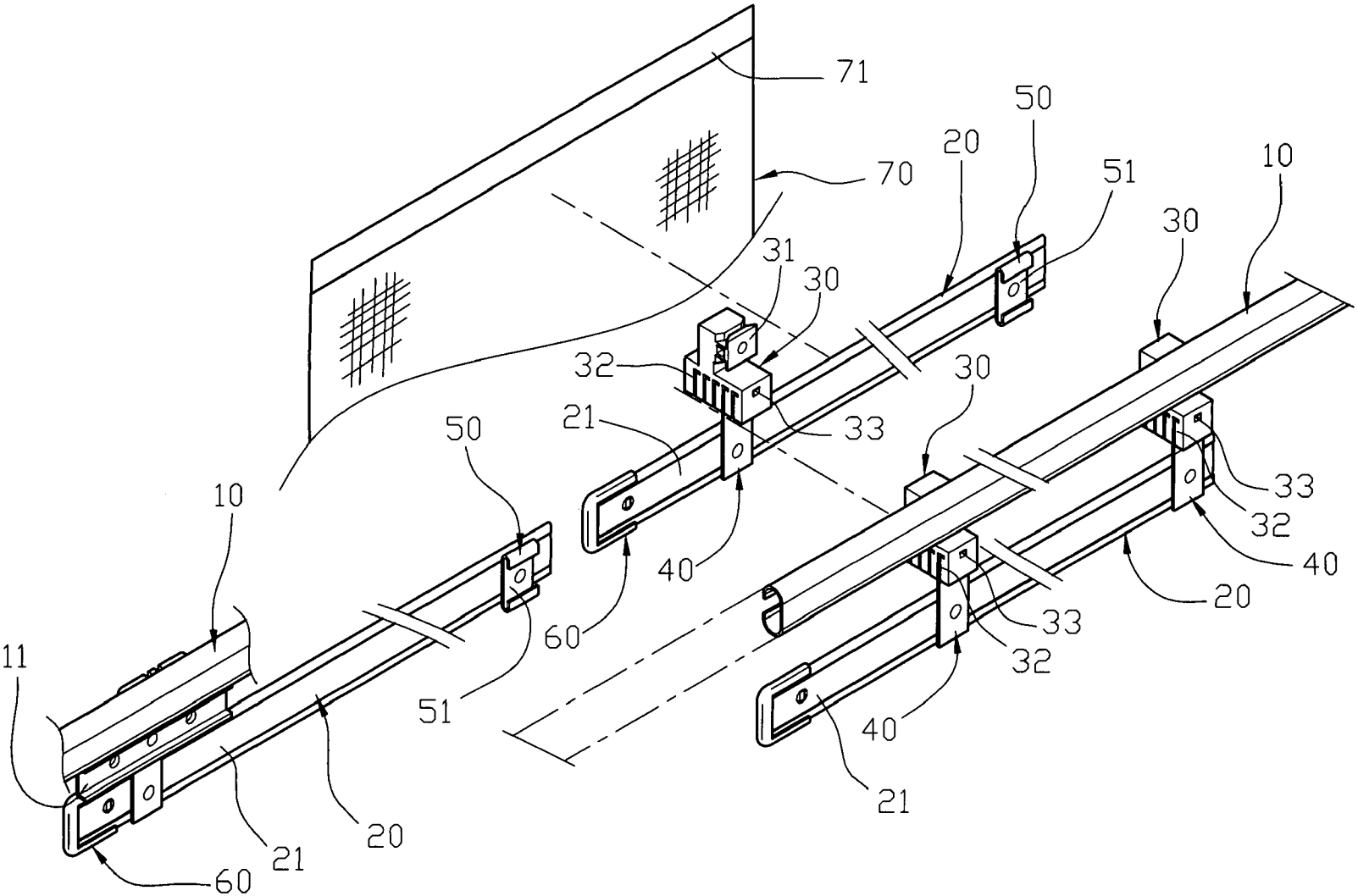
FIG. 2 is an exploded perspective view of the vertical curtain as shown in FIG. 1.
Figure 3:
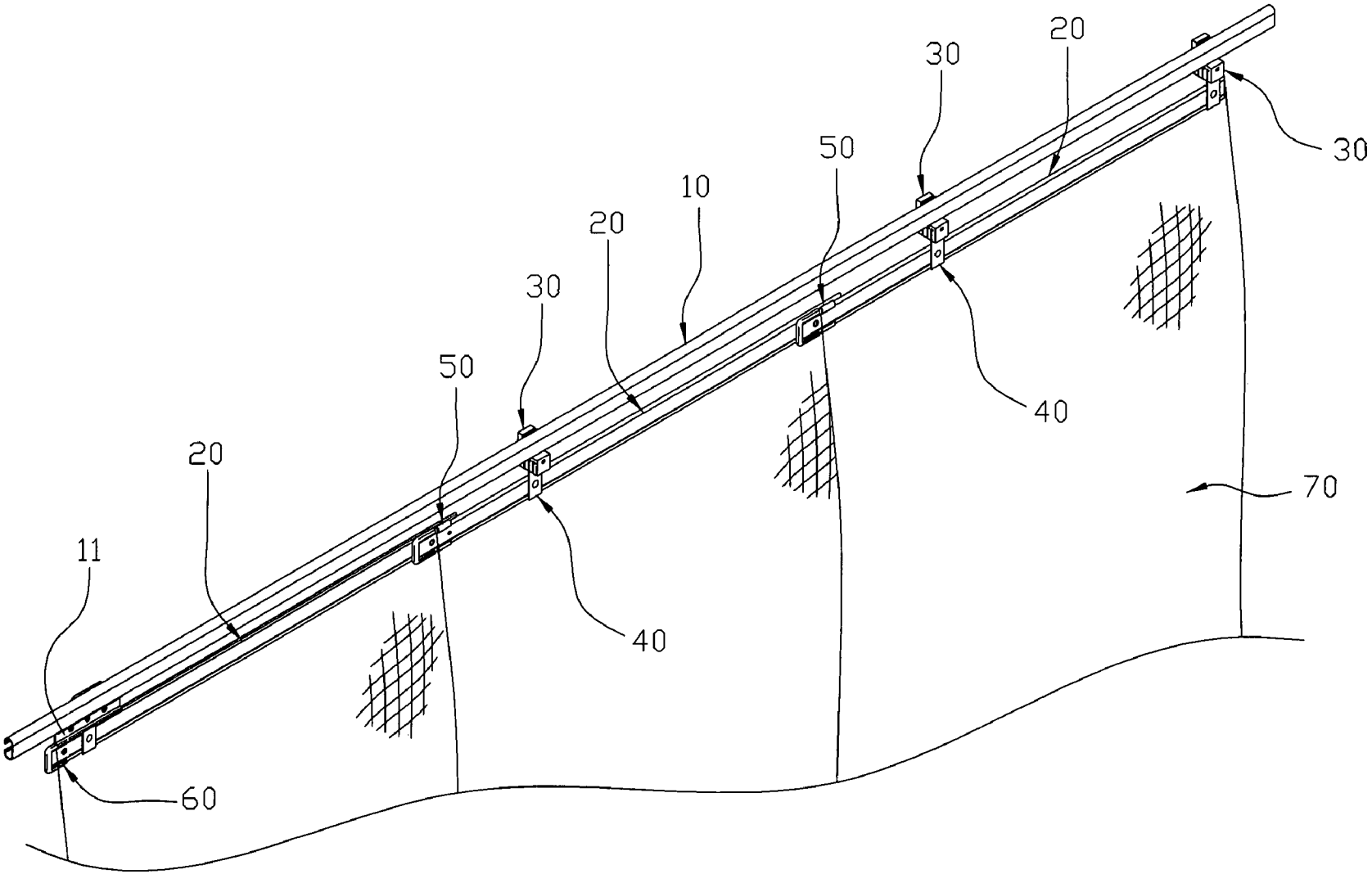
FIG. 3 is a partially perspective view of the vertical curtain (located at a closed state) in accordance with the preferred embodiment of the present invention.
Figure 6:
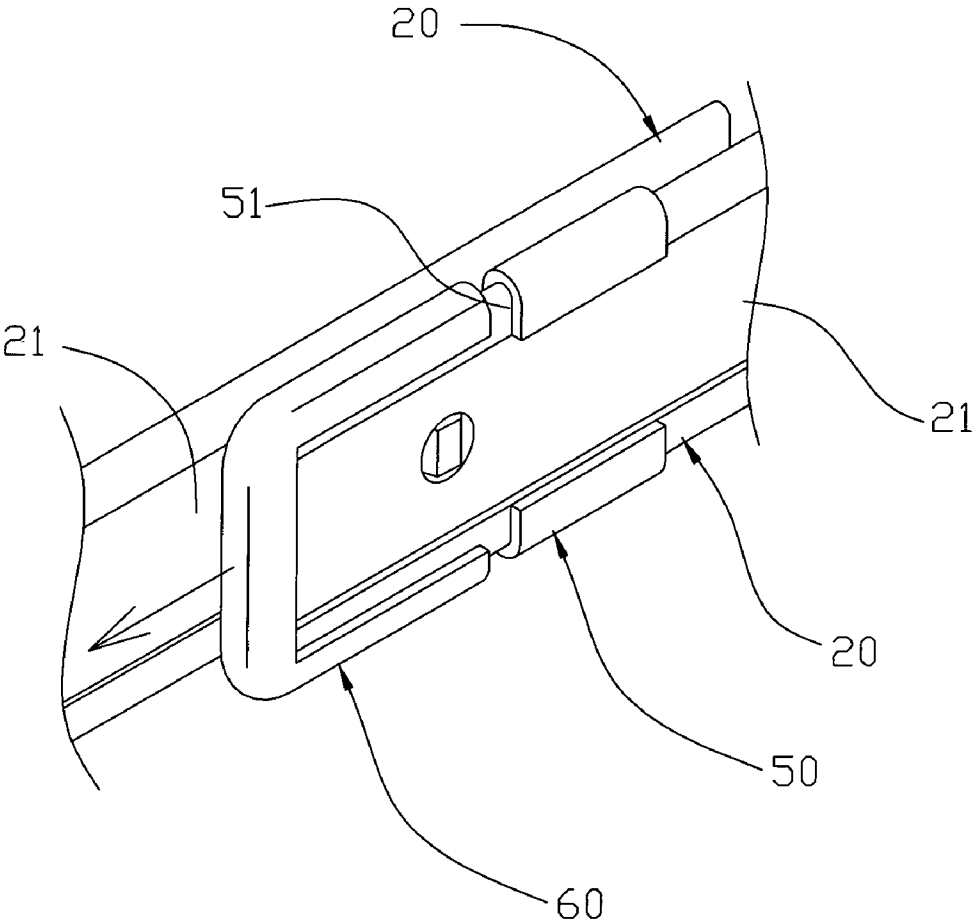
FIG. 6 is a partially enlarged perspective assembly view of the vertical curtain as shown in FIG. 2.

As shown in FIG. 6 with reference to FIGS. 1-3, each of the support brackets 20 has a first end provided with the limit member 50 and a second end provided with the stop member 60. The limit member 50 has an inside formed with a mounting space 51 for mounting the respective support bracket 20. The limit member 50 of each of the support brackets 20 is slidably mounted on an adjacent support bracket 20 and stopped by the stop member 60 of the adjacent support bracket 20 so that each of the support brackets 20 is connected to the adjacent support bracket 20.

In assembly, referring to FIGS. 1-6, each of two support brackets 20 located at the outermost side of the track 10 is provided with two fastening members 40 each combined with one slide member 30 and each attached to a passage 32 located at the outermost side of the slide member 30 as shown in FIGS. 1 and 2. Then, a plurality of inner support brackets 20 are connected to and located between the two support brackets 20 at the outermost side of the track 10. Each of the inner support brackets 20 has a first end provided with a respective limit member 50 and a second end provided with a respective fastening member 40 and a respective stop member 60, wherein the fastening member 40 is combined with a respective slide member 30 and attached to either one of the passages 32 of the respective slide member 30 as shown in FIG. 2 so that the inner support brackets 20 can escape each other when being folded. Each of two support brackets 20 located at the innermost side of the track 10 is combined with a respective one of the two drawing blocks 11. The support brackets 20 are connected with each other, wherein the second end of each of the support brackets 20 is initially extended through the mounting space 51 of the limit member 50 of an adjacent support bracket 20 and is then combined with the respective stop member 60 so that the limit member 50 of each of the support brackets 20 is slidably mounted on an adjacent support bracket 20 and stopped by the stop member 60 of the adjacent support bracket 20. The slide portion 31 of the slide member 30 of each of the support brackets 20 is slidably mounted on the track 10 so that each of the support brackets 20 is movable on the track 10.

In operation, referring to FIGS. 1-3, each of the two drawing blocks 11 is driven by the pull cord to move inward simultaneously to pull the innermost support bracket 20 whose limit member 50 is movable on an adjacent support bracket 20. When the limit member 50 of the innermost support bracket 20 touches the stop member 60 of an adjacent support bracket 20, the adjacent support bracket 20 is pulled by the innermost support bracket 20 to move inward. Thus, the limit member 50 of the innermost support bracket 20 pulls the stop member 60 of an adjacent support bracket 20 whose limit member 50 pulls the stop member 60 of another adjacent support bracket 20 and the above-mentioned procedure is repeated so that all of the support brackets 20 are in turn pulled inward successively to move from the two ends of the track 10 toward the middle portion of the track 10, thereby expanding the support brackets 20 so as to fully expand the vertical slats 70 as shown in FIG. 3, thereby closing the vertical curtain.

Alternatively, the pull cord is pulled in the reverse direction so that each of the two drawing blocks 11 is driven by the pull cord to move outward simultaneously to push the slide member 30 of an adjacent support bracket 20 to push the slide member 30 of another adjacent support bracket 20. Thus, the above-mentioned procedure is repeated so that all of the support brackets 20 are in turn pulled outward successively to move from the middle portion of the track 10 toward the two ends of the track 10, thereby folding the support brackets 20 as shown in FIG. 1 so as to fully fold the vertical slats 70, thereby opening the vertical curtain.

Figure 7:
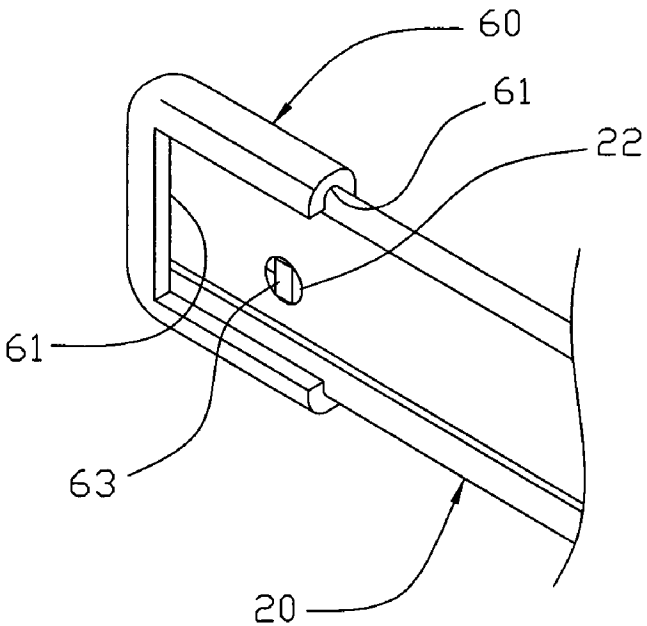
FIG. 7 is a partially enlarged perspective view of the vertical curtain as shown in FIG. 1.
Figure 8:
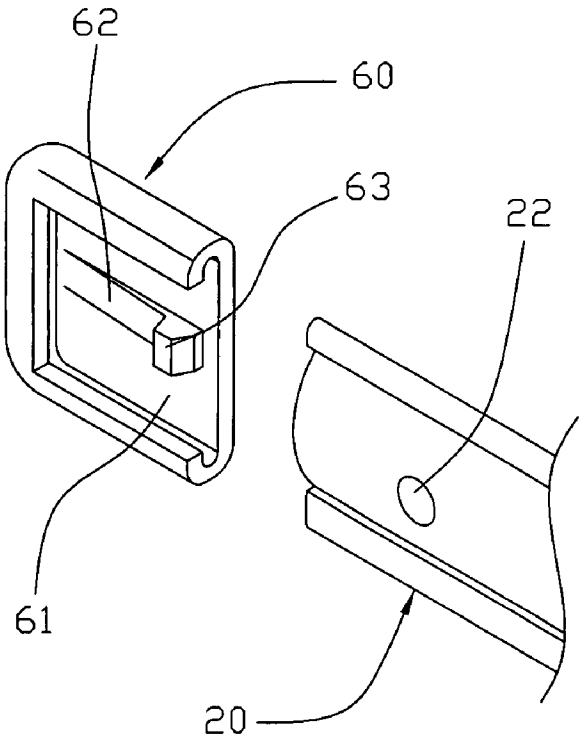
FIG. 8 is an exploded perspective view of the vertical curtain as shown in FIG. 7.

Referring to FIGS. 7 and 8, the second end of each of the support brackets 20 is formed with a positioning hole 22, and the stop member 60 includes a hollow mounting portion 61 mounted on the second end of each of the support brackets 20, and an elastic strip 62 mounted between the mounting portion 61 and the second end of each of the support brackets 20 and has a distal end formed with a locking hook 63 snapped into and locked in the positioning hole 22 of the second end of each of the support brackets 20 to fix the stop member 60 on each of the support brackets 20.

Figure 9:
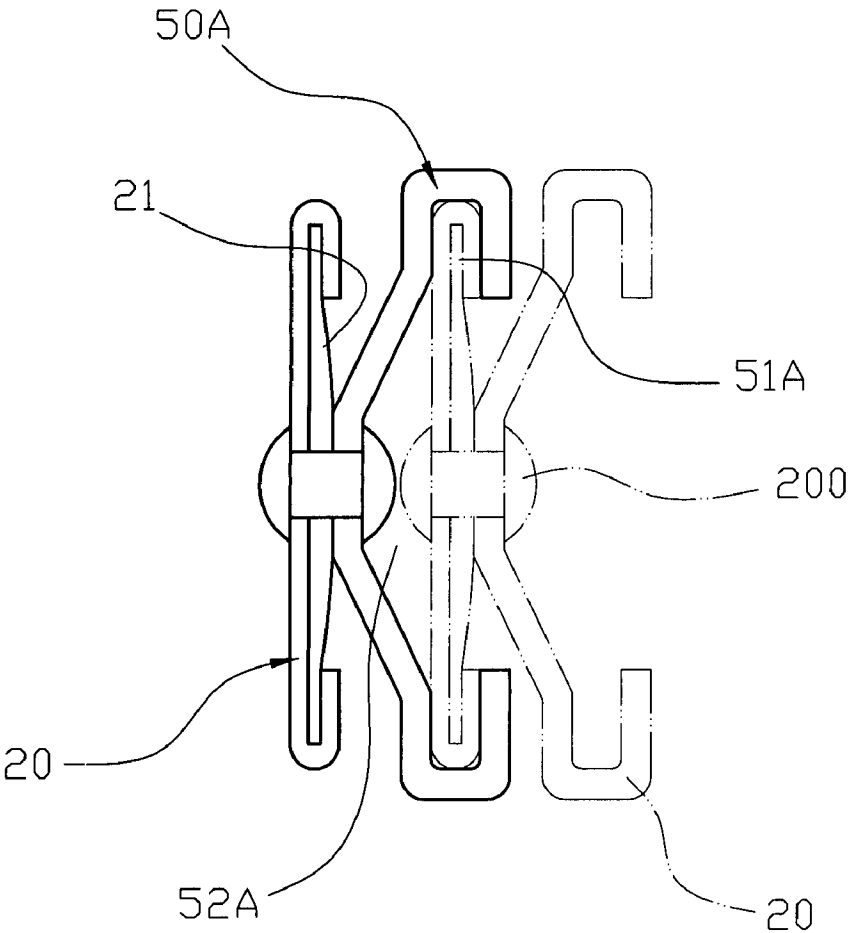
FIG. 9 is a partially side plan view of a vertical curtain in accordance with another preferred embodiment of the present invention.

Referring to FIG. 9, the mounting space 51A of the limit member 50A has a mediate portion formed with a recess 52A to allow passage of a rivet (or screw) 200 mounted on an adjacent support bracket 20.

Figure 10:
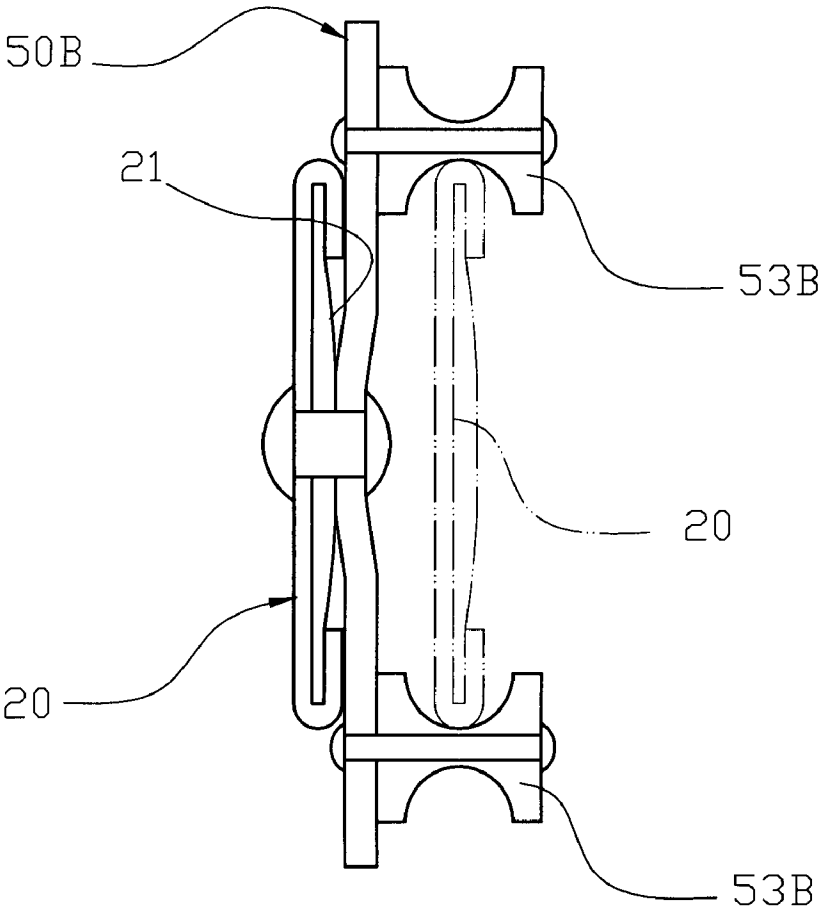
FIG. 10 is a partially side plan view of a vertical curtain in accordance with another preferred embodiment of the present invention.

Referring to FIG. 10, the limit member 50B is provided with two opposite rollers 53B for supporting an adjacent support bracket 20 so that the limit member 50B is slidably mounted on the adjacent support bracket 20.

Accordingly, the slide member 30 has a plurality of passages 32 having different positions for mounting the vertical slats 70 so that the track 10 can be used to combine with multiple vertical slats 70, and the vertical curtain is available for windows having larger sizes, thereby enhancing the versatility of the vertical curtain. In addition, the support brackets 20 are in turn pulled successively by interaction between the limit member 50 and the stop member 60 so that the vertical slats 70 are expanded and folded easily and conveniently, thereby facilitating a user closing and opening the vertical curtain.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A vertical curtain, comprising:

a track having two ends each provided with a plurality of support brackets juxtaposed to each other, and two drawing blocks movably mounted on the two ends of the track and connected to one of the support brackets to push the support brackets; wherein each of the support brackets is movably mounted on the track and provided with a slide member, a fastening member, a limit member and a stop member;

the slide member has a first end formed with a slide portion slidably mounted on the track and a second end having an inside formed with an elongated positioning groove and an end face formed with a plurality of substantially inverted L-shaped passages each connected to the positioning groove;

the fastening member has a first end attached to the slide member to move therewith and formed with a hanging hook extended through either one of the passages of the slide member and detachably positioned in the positioning groove of the slide member;

the fastening member has a second end secured to the respective support bracket to move the respective support bracket;

each of the support brackets has a first end provided with the limit member and a second end provided with the stop member.

2. The vertical curtain in accordance with claim 1, wherein the two drawing blocks are connected to a pull cord so that each of the two drawing blocks is driven by the pull cord to push the support brackets to move from the two ends of the track toward a middle portion of the track or to move from the middle portion of the track toward the two ends of the track.

3. The vertical curtain in accordance with claim 1, wherein each of the support brackets is combined with a vertical slat by the fastening member.

4. The vertical curtain in accordance with claim 1, wherein the track is a substantially C-shaped tubular body.

5. The vertical curtain in accordance with claim 1, wherein each of the passages has an upper portion located at a height greater than that of the positioning groove.

6. The vertical curtain in accordance with claim 1, wherein the first end of the fastening member is removably mounted on and can be detached from the slide member.

7. The vertical curtain in accordance with claim 3, wherein the vertical slat has an upper end located between the respective support bracket and the second end of the fastening member.

8. The vertical curtain in accordance with claim 3, wherein each of the support brackets has a side provided with a bonding strap, and the vertical slat has an upper end provided with a bonding strap detachably bonded on the bonding strap of the respective support bracket.

9. The vertical curtain in accordance with claim 1, wherein the limit member has an inside formed with a mounting space for mounting the respective support bracket.

10. The vertical curtain in accordance with claim 1, wherein the limit member of each of the support brackets is slidably mounted on an adjacent support bracket and stopped by the stop member of the adjacent support bracket so that each of the support brackets is connected to the adjacent support bracket.

11. The vertical curtain in accordance with claim 1, wherein the support brackets are connected with each other, the second end of each of the support brackets is extended through a mounting space of the limit member of an adjacent support bracket and is combined with the respective stop member so that the limit member of each of the support brackets is slidably mounted on an adjacent support bracket and stopped by the stop member of the adjacent support bracket.

12. The vertical curtain in accordance with claim 1, wherein the slide portion of the slide member of each of the support brackets is slidable on the track so that each of the support brackets is movable on the track.

13. The vertical curtain in accordance with claim 1, wherein:

each of two support brackets located at the outermost side of the track is provided with two fastening members each combined with one slide member and each attached to a passage located at the outermost side of the slide member;

a plurality of inner support brackets are connected to and located between the two support brackets at the outermost side of the track;

each of the inner support brackets has a first end provided with a respective limit member and a second end provided with a respective fastening member and a respective stop member, wherein the fastening member is combined with a respective slide member and attached to either one of the passages of the respective slide member so that the inner support brackets can escape each other when being folded;

each of two support brackets located at the innermost side of the track is combined with a respective one of the two drawing blocks.

14. The vertical curtain in accordance with claim 1, wherein the second end of each of the support brackets is formed with a positioning hole, and the stop member includes a hollow mounting portion mounted on the second end of each of the support brackets, and an elastic strip mounted between the mounting portion and the second end of each of the support brackets and has a distal end formed with a locking hook snapped into and locked in the positioning hole of the second end of each of the support brackets to fix the stop member on each of the support brackets.

15. The vertical curtain in accordance with claim 1, wherein the limit member has an inside formed with a mounting space having a mediate portion formed with a recess.

16. The vertical curtain in accordance with claim 1, wherein the limit member is provided with two opposite rollers for supporting an adjacent support bracket so that the limit member is slidably mounted on the adjacent support bracket.

* * * * *